US009952010B1

(12) United States Patent
Lutsch

(10) Patent No.: US 9,952,010 B1
(45) Date of Patent: Apr. 24, 2018

(54) SPEED LOADER FOR T-SHIRT GATLING GUN

(71) Applicant: Keith Lutsch, Houston, TX (US)

(72) Inventor: Keith Lutsch, Houston, TX (US)

( * ) Notice: Subject to any disclaimer, the term of this patent is extended or adjusted under 35 U.S.C. 154(b) by 0 days.

(21) Appl. No.: 15/796,822

(22) Filed: Oct. 29, 2017

(51) Int. Cl.

| | |
|---|---|
| ***F41B 11/00*** | (2013.01) |
| ***F41A 9/36*** | (2006.01) |
| ***F41B 11/80*** | (2013.01) |
| *F41B 11/54* | (2013.01) |

(52) U.S. Cl.
CPC ..... *F41A 9/36* (2013.01); *F41B 11/80* (2013.01); *F41B 11/54* (2013.01)

(58) Field of Classification Search
CPC ..... F41B 7/006; F41B 11/50; F41B 11/54; F41B 11/80
See application file for complete search history.

(56) References Cited

U.S. PATENT DOCUMENTS 2,222,125 A * 11/1940 Stehlik ..... B25C 3/002 124/48
2,609,811 A * 9/1952 Lawrence ..... F41B 11/54 124/41.1
3,726,266 A * 4/1973 Palmer ..... F41B 11/54 124/48
5,282,455 A * 2/1994 Adamson ..... F41A 9/26 124/48
2012/0279483 A1* 11/2012 Hase ..... F41B 11/54 124/77

OTHER PUBLICATIONS tshirtgun.com, "T-Shirt Gatling Gun", before Oct. 29, 2017.
tshirtgun.com, "Gatling Gun T-shirt Launcher Manual", before Oct. 29, 2017.
FXinMotion, "Double Barrel T-Shirt Gatling Gun", before Oct. 29, 2017.
FXinMotion, "Triple Barrel T-Shirt Gatling Gun", before Oct. 29, 2017.

* cited by examiner

*Primary Examiner* — John Ricci

(57) ABSTRACT

A T-shirt Gatling gun speed loader that includes a series of tubes that mate with the tubes of a T-shirt Gatling gun. T-shirts to be loaded into the T-shirt Gatling gun are located in the speed loader tubes. A series of pushrods are located coaxially with the speed loader tubes and extend for a distance that is approximately the length of the tubes of the T-shirt Gatling gun. These pushrods are mounted at a second end to a push plate so that by inserting the speed loader tubes into the T-shirt Gatling gun tubes and pushing the push plate, the T-shirts are loaded into the T-shirt Gatling gun at a distance to allow proper firing of the T-shirts. The speed loader is then withdrawn from the T-shirt Gatling gun.

6 Claims, 11 Drawing Sheets

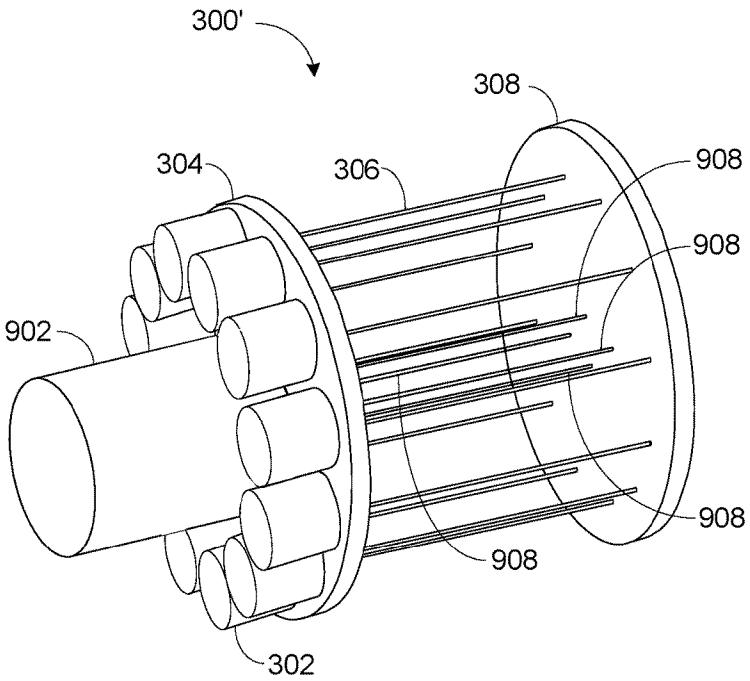
Fig. 10
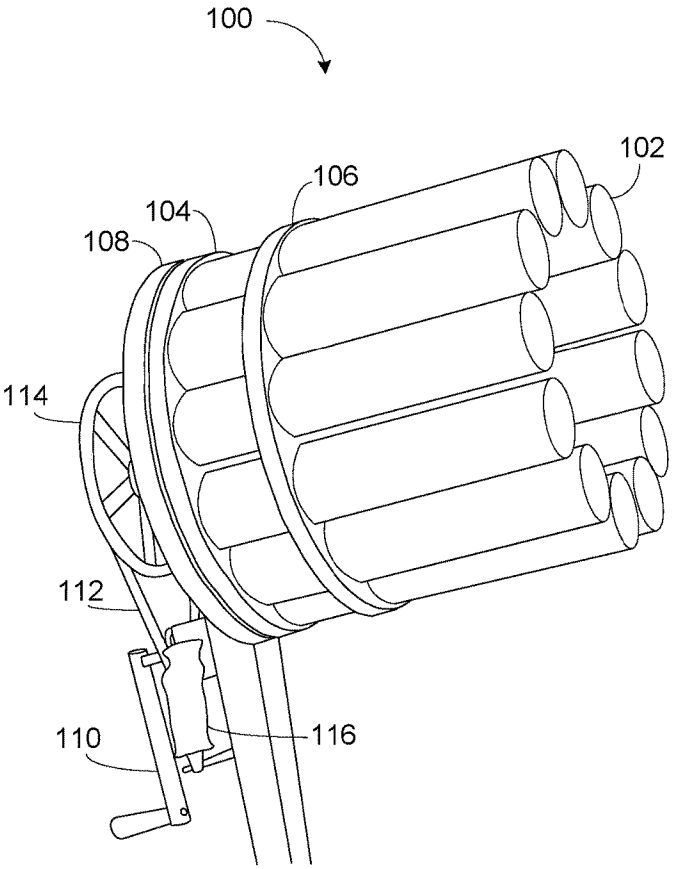

SPEED LOADER FOR T-SHIRT GATLING GUN

FIELD OF THE INVENTION

The invention relates to T-shirt guns, and more specifically to T-shirt Gatling guns.

BACKGROUND OF THE INVENTION

People get great enjoyment from attending sporting events. The experience is made even better by the opportunity to catch a T-shirt thrown to the stands. Originally, T-shirts were thrown by hand by various team-affiliated individuals. As that relied on the strength and arm of the individual, which was often limited, the use of handheld or multi-person slingshots developed to allow the T-shirts to be delivered to higher locations, such as upper decks. But operating a slingshot takes experience, so the T-shirt gun was developed. A T-shirt gun is a tube into which a T-shirt is placed and then fired using a compressed air blast. The T-shirt gun allows much better accuracy than slingshots while allowing the same potential distance. One issue with the T-shirt gun was that only a single T-shirt was delivered each time and if the individual shooting the gun was in a moving vehicle, this resulted in many attendees being skipped. To address that problem, the T-shirt Gatling gun was developed. See www.tshirtgun.com/gatlinggun_t-shirt.html. A T-shirt Gatling gun consists of a series of tubes into which T-shirts are inserted from an open end. A wheel is turned to rotate the T-shirt Gatling gun and as a tube passes a given location, a compressed air blast is provided to shoot the T-shirt from the tube. The use of the T-shirt Gatling gun allows many T-shirts to be rapidly fired into the audience, even from a moving vehicle. However, the problem developed that now multiple barrels, such as 12, needed to be reloaded to provide another complete delivery of T-shirts. Loading 12 T-shirts into 12 barrels takes a great deal of time, and if the T-shirt Gatling gun is located in a moving vehicle, again the problem of missing attendees develops and is actually exacerbated because of the number of barrels that need to be loaded.

Audience enjoyment would be further increased if a way was developed to quickly load the T-shirt Gatling gun so that fewer people are missed as a vehicle carrying the T-shirt Gatling gun travels along.

SUMMARY OF THE INVENTION

A T-shirt Gatling gun speed loader according to the present invention includes a series of tubes that mate with the tubes of the T-shirt Gatling gun that is to be loaded. T-shirts to be loaded into the T-shirt Gatling gun are located in the speed loader tubes. A series of pushrods are located coaxially with the speed loader tubes and extend for a distance that is approximately the length of the tubes of the T-shirt Gatling gun. Preferably these pushrods are mounted at a second end to a push plate so that by simply inserting the speed loader tubes into the T-shirt Gatling gun tubes and pushing the push plate, the T-shirts are loaded into the T-shirt Gatling gun at a distance to allow proper firing of the T-shirts. By having the speed loader preloaded with T-shirts and the pushrods retracted, it is then possible to very quickly reload the T-shirt Gatling gun, even as a vehicle is moving. The speed loader is then withdrawn from the T-shirt Gatling gun and the T-shirt Gatling gun is ready to fire another full round of T-shirts.

Recognizing that the pushrods are just a series of rods, in some cases it might be desirable to have additional stability to prevent racking of the pushing assembly. In that case, a cylinder with a set of internal tubes is installed on the plate which holds the speed loader tubes and inside the ring of the speed loader tubes, such that the cylinder fits inside the ring of tubes of the T-shirt Gatling gun. A series of guide rods are then placed on the push plate to align with internal tubes located in the cylinder, so that the guide rods tightly fit the tubes to limit the racking of the assembly.

In other embodiments the leading edge of the speed loader tubes may be cut at an angle to improve registration of the speed loader tubes with the tubes of the T-shirt Gatling gun.

BRIEF DESCRIPTION OF THE DRAWINGS

The accompanying drawings, which are incorporated in and constitute a part of this specification, illustrate an implementation of apparatus and methods consistent with the present invention and, together with the detailed description, serve to explain advantages and principles consistent with the invention.

FIG. 10 is an isometric view of a T-shirt Gatling gun and a speed loader with a stabilizing cylinder according to the present invention.

DETAILED DESCRIPTION

Figure 1:
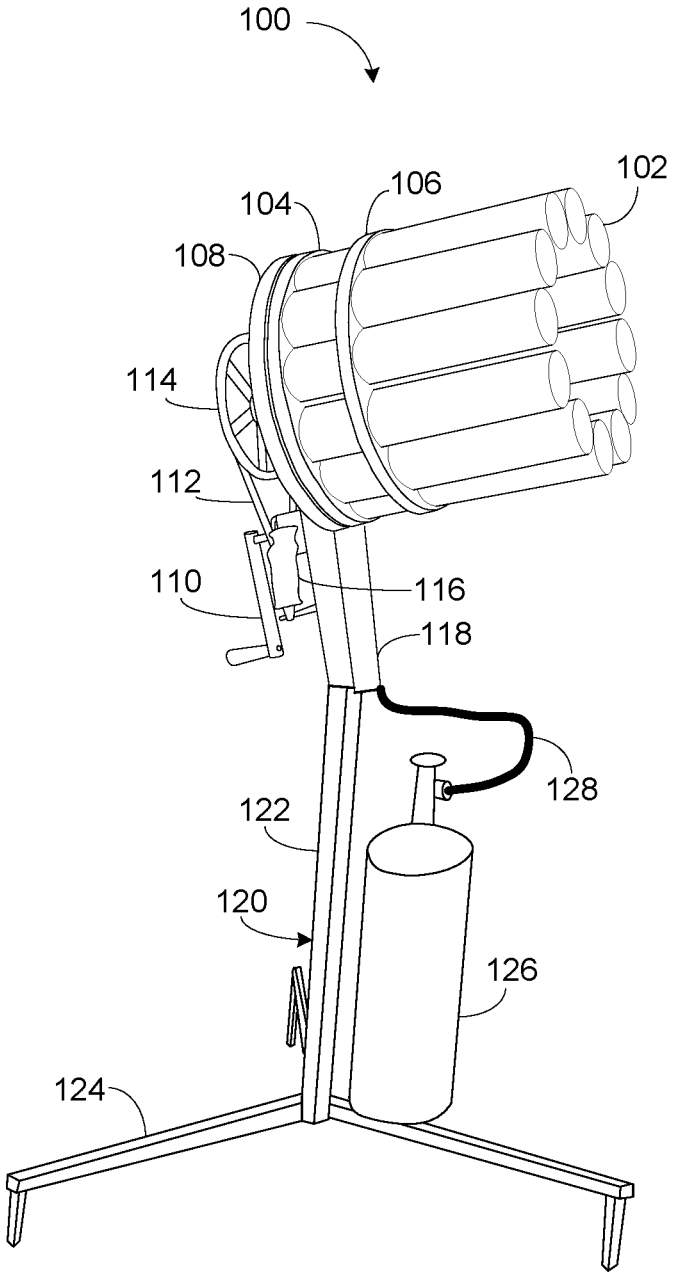
Fig. 1 (Prior Art)
FIG. 1 is a perspective view of a T-shirt Gatling gun according to the prior art.
Figure 2:
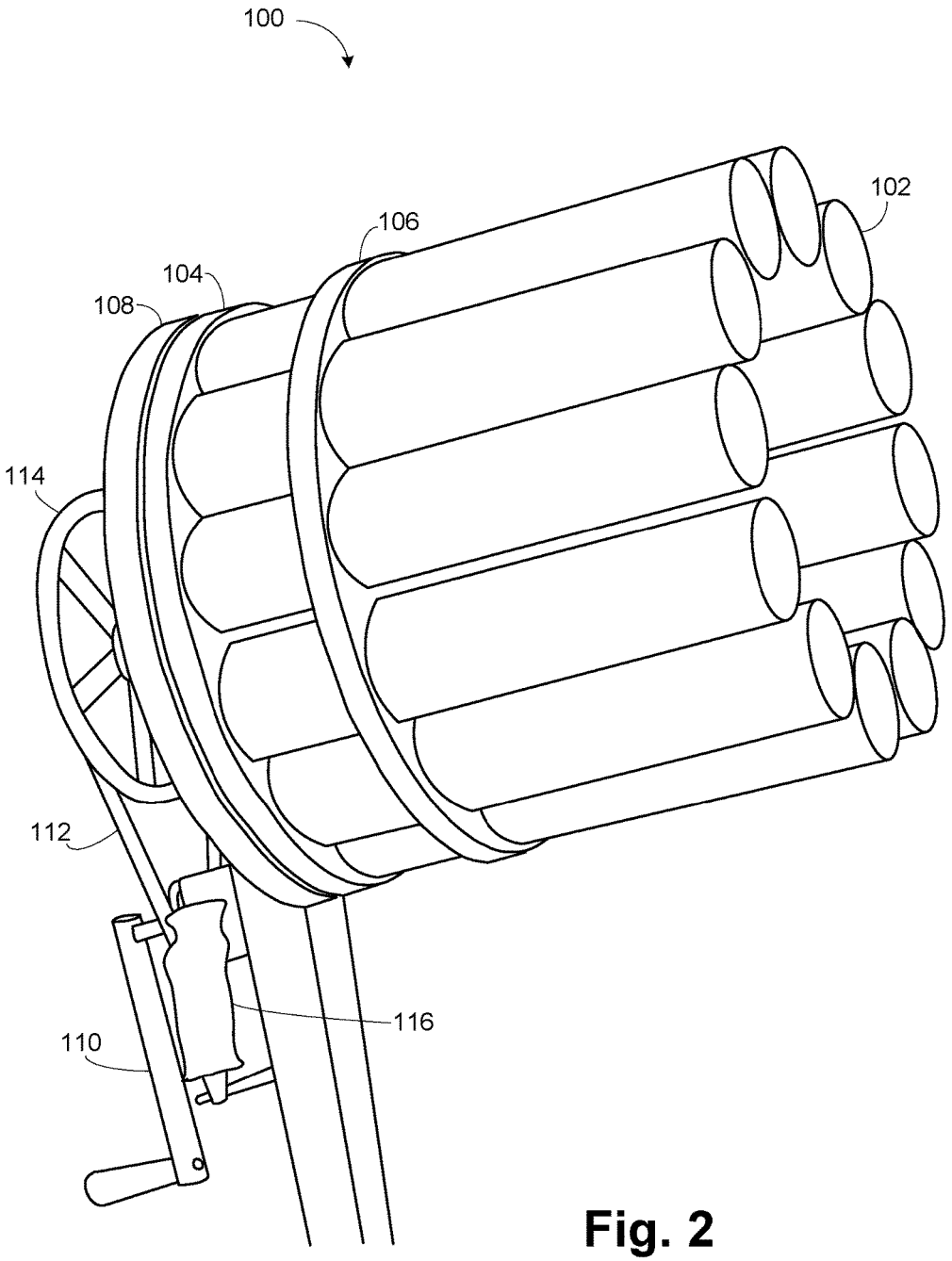
Fig. 2 (Prior Art)
FIG. 2 is an enlarged view of the T-shirt head of the T-shirt Gatling gun of FIG. 1.

A T-shirt Gatling gun 100 according to the prior art is shown in FIGS. 1 and 2. A series of tubes 102 are circumferentially located around a central axis. The tubes 102 are used to receive the T-shirts and to provide a barrel for shooting the T-shirts. Preferably the tubes 102 are a clear plastic material. The tubes 102 have a given diameter and thickness so that the tubes 102 have an inner diameter and an outer diameter. The tubes 102 also have a given length and an axis. The tubes 102 are affixed on a circular end plate 104, the central axis being at the center of the end plate 104. A circular retaining plate 106 having a series of circumferential holes to align with the tubes 102 is provided a spaced distance from the end plate 104 to allow the tubes 102 to be securely held. A fixed plate 108 is provided behind the end plate 104 and is used in cooperation with a firing assembly (not shown) to fire a T-shirt from a given tube 102.

A crank no has a belt 112 connected to a wheel 114. The wheel 114 has an axle (not shown) mounted at the center of the end plate 104 and passing through the fixed plate 108. When the operator cranks the crank no, the end plate 104 and the tubes 102 rotate. A trigger assembly 116 is provided to coordinate the firing of the T-shirts from the T-shirt Gatling gun 100. A button (not shown) on the trigger assembly 116 is held down while the crank no is turned and then as the end plate 104 passes the firing assembly the T-shirt in the particular tube 102 is shot from the T-shirt Gatling gun 100.

In the illustrated embodiment, an upper stand portion 118 is connected to the plate 108 and is connected to a tripod 120, which includes a upper support 122 and three legs 124. A compressed gas cylinder 126 is located on one of the legs 124 and includes a hose 128 leading to the firing assembly to provide the compressed gas to fire the T-shirts.

Briefly, as the crank no is rotated, the tubes 102 rotated around the central axis of the assembly and fire as each tube 102 passes the firing assembly. This allows a rapid firing of T-shirts from the T-shirt Gatling gun 100 to the great pleasure of the audience.

Figure 3:
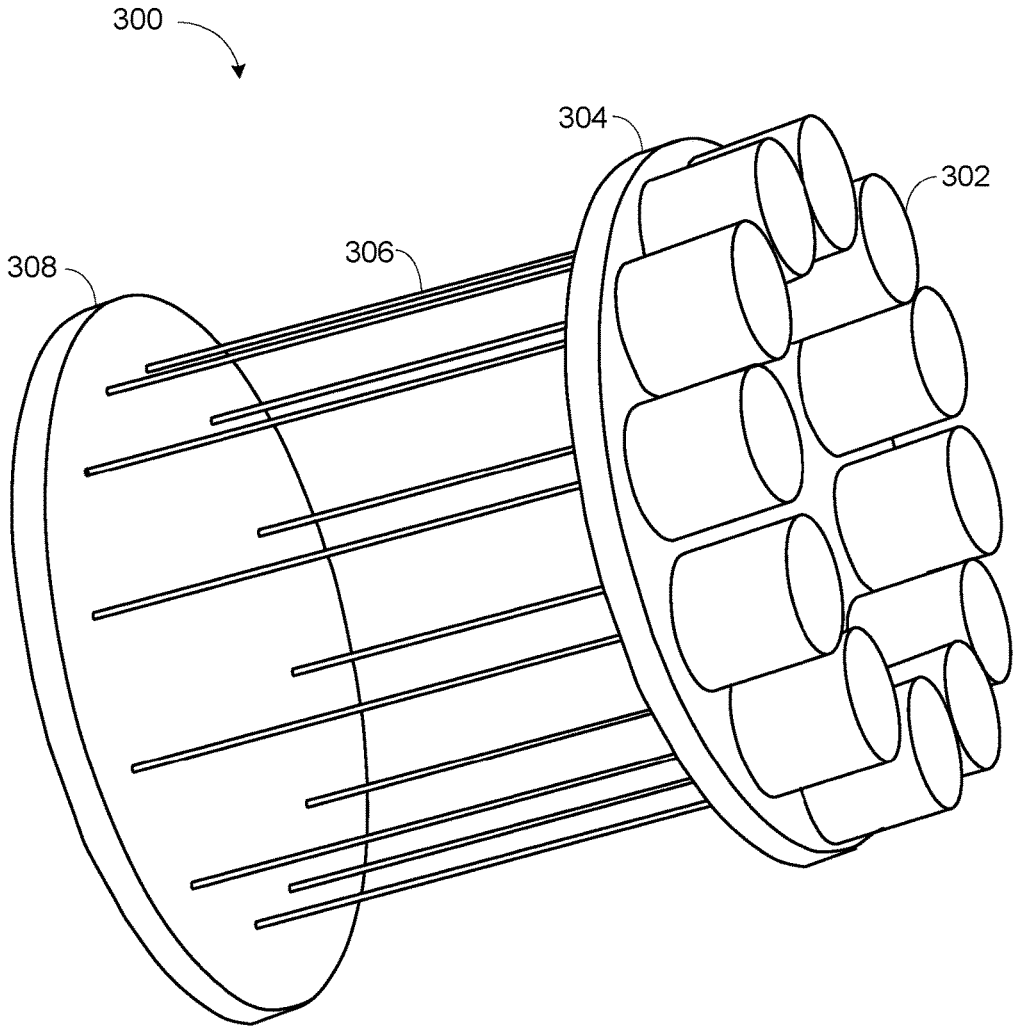
FIG. 3 is a perspective view of a speed loader according to the present invention.

A speed loader 300 according to the present invention is shown in FIG. 3. A series of tubes 302 are circumferentially located around a central axis and are mounted to a cylindrical plate 304, the center of the plate 304 aligning with the central axis. The tubes 302 have an axis, a given diameter and a thickness so that the tubes 302 have an inner diameter and an outer diameter. The tube 302 outer diameter is less than the tube 102 inner diameter to allow the tubes 302 to be inserted into the tubes 102. A series of pushrods 306, one for each tube 302 and preferably aligned with the axis of the tube 302, are mounted to a push plate 308 and pass through an opening in the plate 304.

Briefly, T-shirts are placed into the tubes 302, the speed loader 300 is positioned on the T-shirt Gatling gun 100, the push plate 308 is depressed and the pushrods 306 travel down the length of the T-shirt Gatling gun tubes 102 to place the T-shirts in the proper location for firing. The speed loader 300 is then withdrawn from the T-shirt Gatling gun 100.

Figure 4:
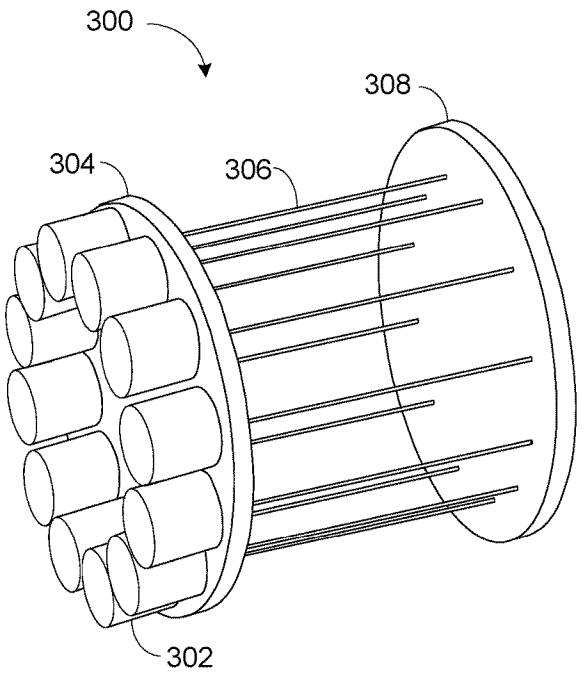
FIG. 4 is a perspective view of the head of the T-shirt Gatling gun and the speed loader according to the present invention.
Figure 4:
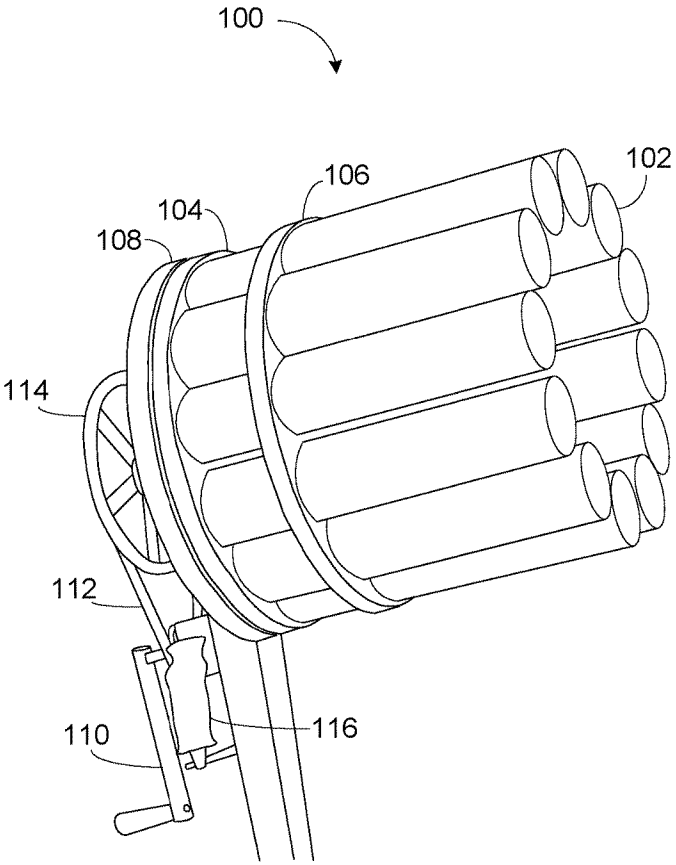

FIG. 4 illustrates the relationship of the T-shirt Gatling gun 100 and the speed loader 300. As can be seen, the tubes 302 of the speed loader 300 mate with the tubes 102 of the T-shirt Gatling gun 100 to allow the tubes 302 and 102 to be properly lined up and have the T-shirts readily in the proper location when the push plate 308 is pushed.

Figure 5:
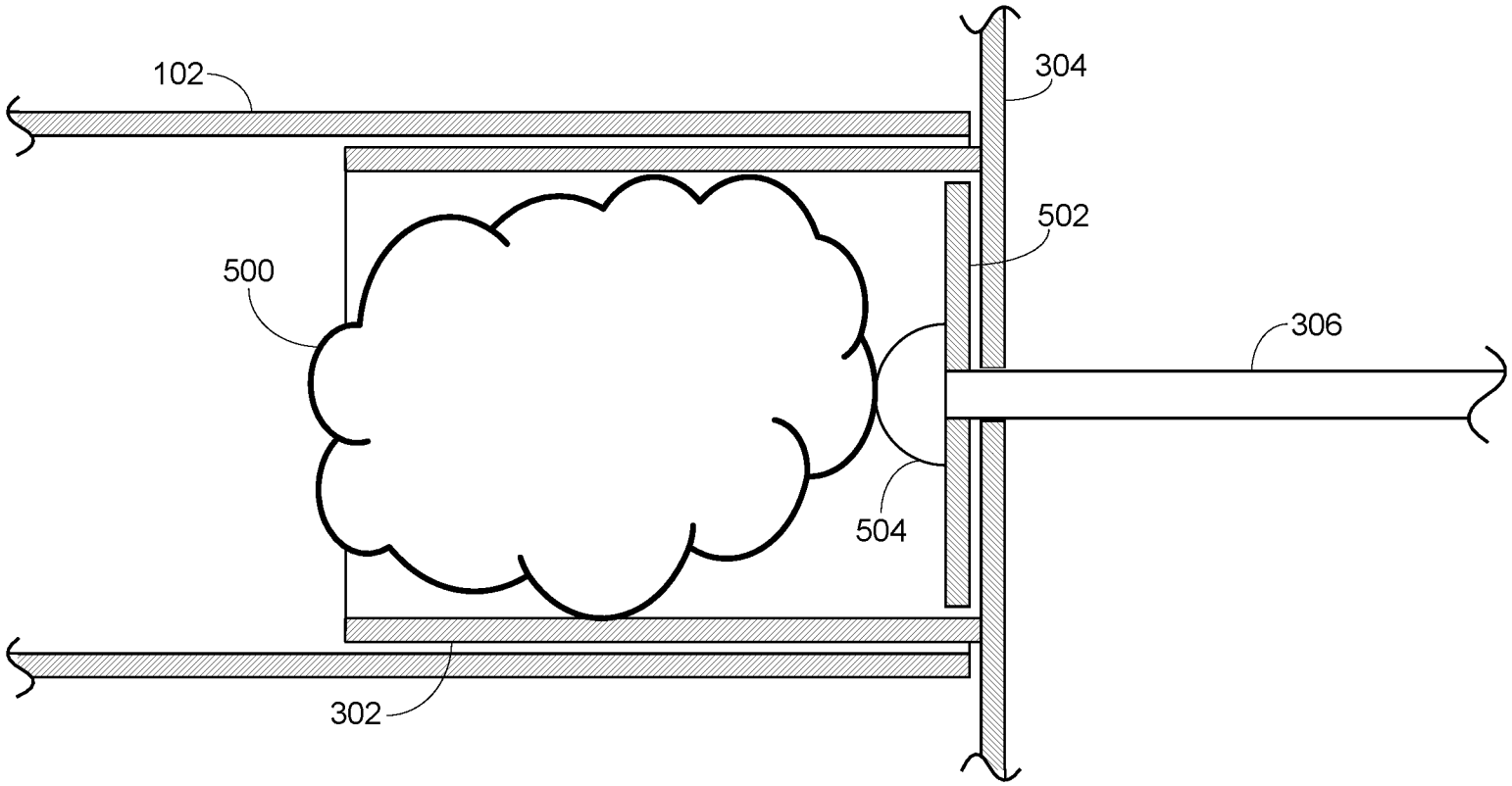
FIG. 5 is an enlarged partial cross-sectional view of one tube of the speed loader when located in the T-shirt Gatling gun according to the present invention.

The relationship between the tubes 102 and the tubes 302 is better illustrated in FIG. 5. In the illustration, a speed loader tube 302 is located inside and at the open end of a T-shirt Gatling gun tube 102. It can be seen that the outer diameter of the speed loader tube 302 is slightly smaller than the inner diameter of the T-shirt Gatling gun tube 102 to allow the tubes 302 be readily inserted into the tubes 102. A T-shirt 500 is located in the speed loader tube 302. An end plate 502 is connected to the pushrod 306 and is located inside the tube 302 to provide a surface area to push the T-shirt 500. The end plate 502 is sized to slide easily inside both tubes 302 and 102. A nut 504 holds the plate 502 onto the pushrod 306 to secure the assembly.

Figure 6:
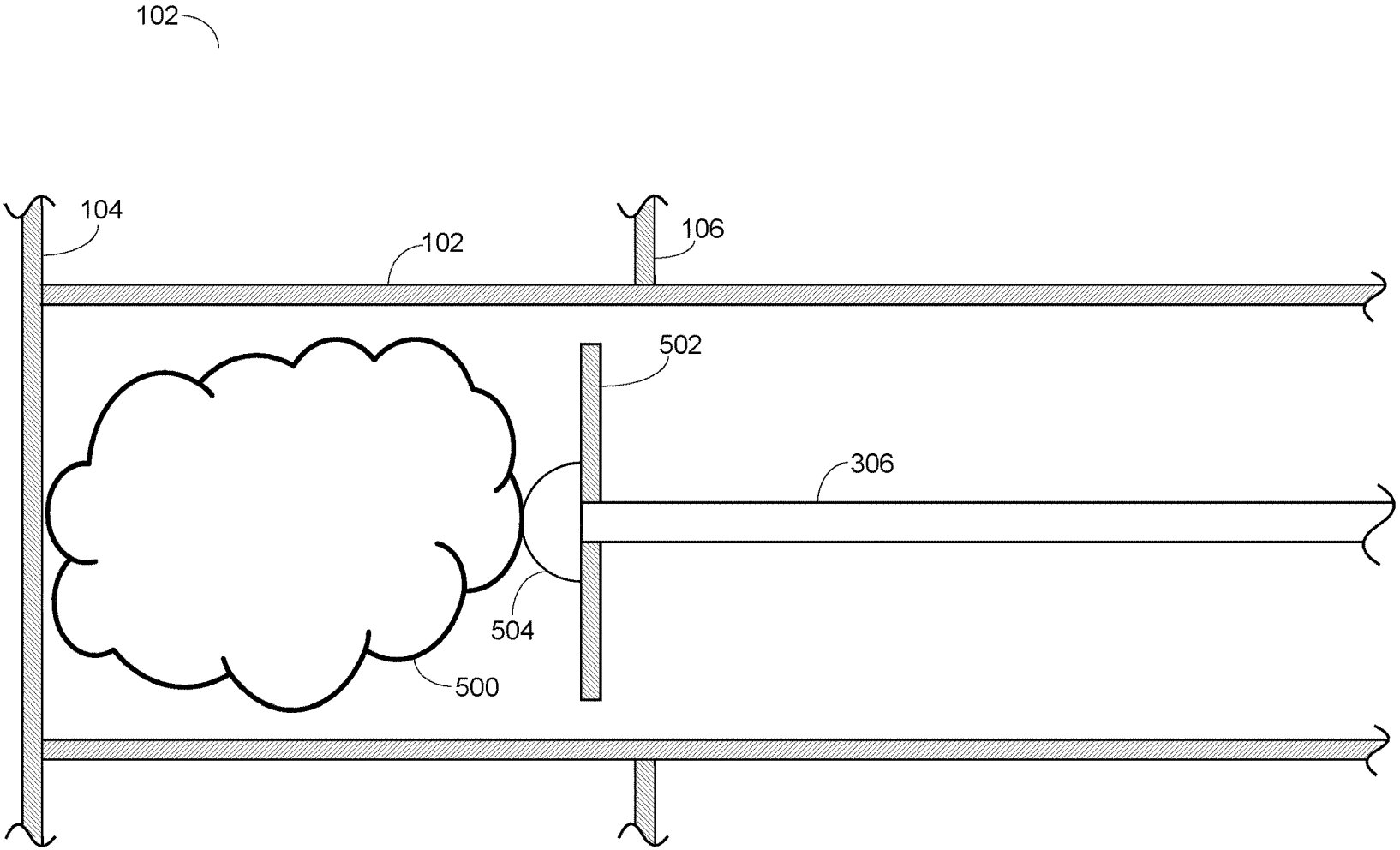
FIG. 6 is an enlarged partial cross-sectional view of the T-shirt Gatling gun with the pushrod of the speed loader fully extended according to the present invention.

FIG. 6 is an illustration of a T-shirt Gatling gun tube 102 when the pushrod 306 is fully extended into the tube 102, so that the T-shirt 500 is now at the bottom of the tube 102 in a firing position. It is noted that the T-shirt 500 may be slightly snuggly held in the tube 302 but that is desirable as it allows the T-shirts to be more positively retained in the relatively short tubes 302 as compared to the long tubes 102.

Figure 7:
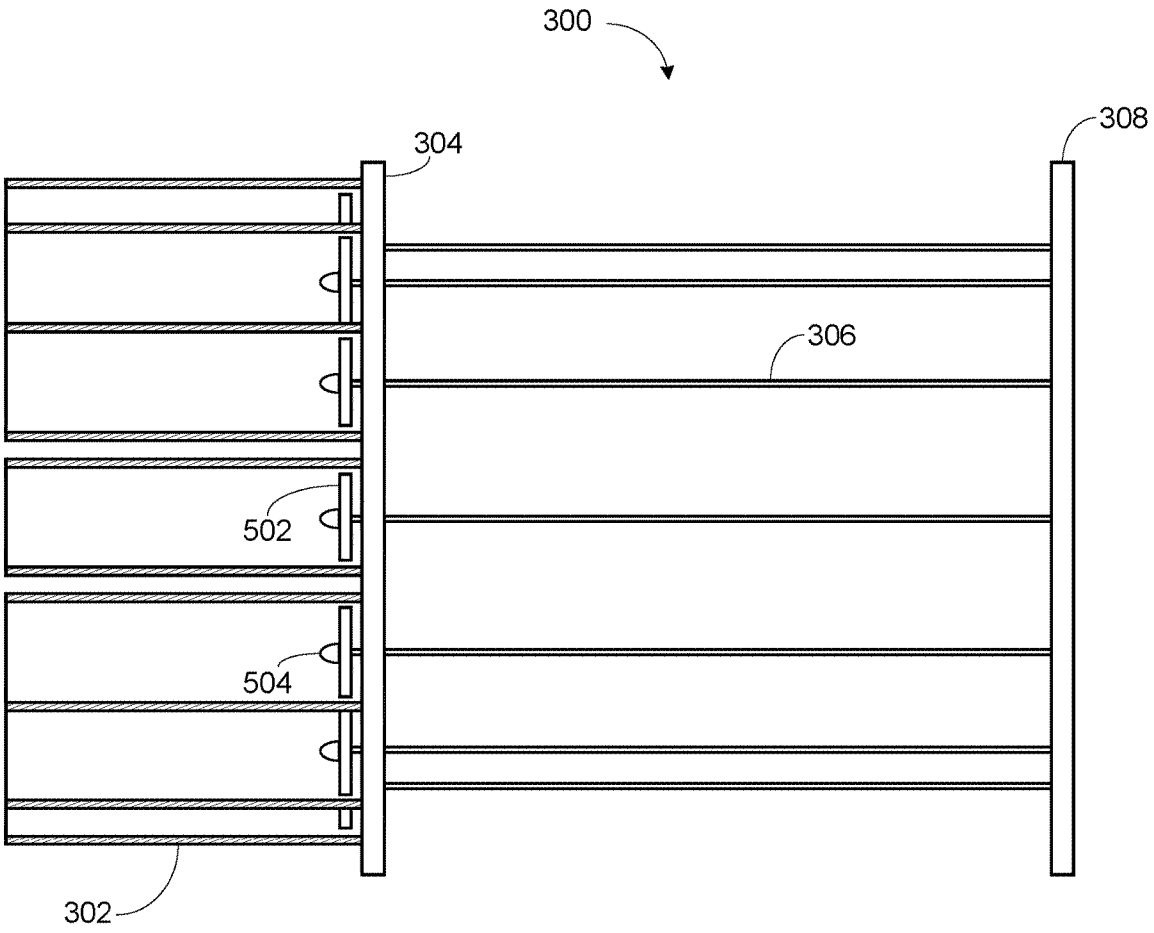
FIG. 7 is a side view in partial cross-section of a speed loader according to the present invention in fully retracted position.

FIG. 7 illustrates the speed loader 300 in the fully retracted position where the pushrods 306 are fully retracted from the plate 304, so that the plates 502 are effectively in contact with the plate 304 and ready for insertion of the T-shirts 500. As can be seen, the pushrods 306 are preferably much longer than the tubes 302 and are of a length such that when fully extended into the tubes 102, the plates 502 are effectively a T-shirt distance away from the plate 104.

Figure 8:
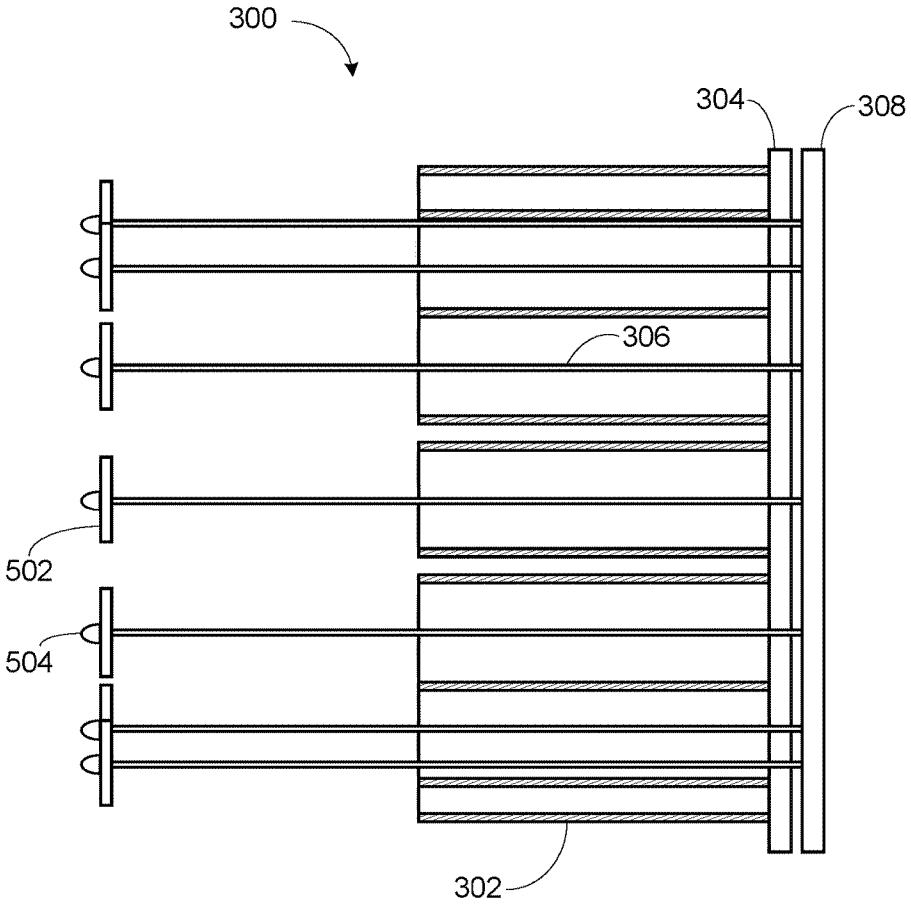
FIG. 8 is a side view in partial cross-section of the speed loader according to the present invention in fully extended position.

In FIG. 8 the pushrods 306 are fully extended and the push plate 308 is in contact or near contact with the plate 304. The push plate 308 is pulled away from the plate 304 and the pushrods 306 retract. There may be some difficulty getting the end plates 502 back into the tubes 302, but this is not a concern as the reloading of the speed loader 300 can be done during breaks when the reloading time is not critical.

Figure 9:
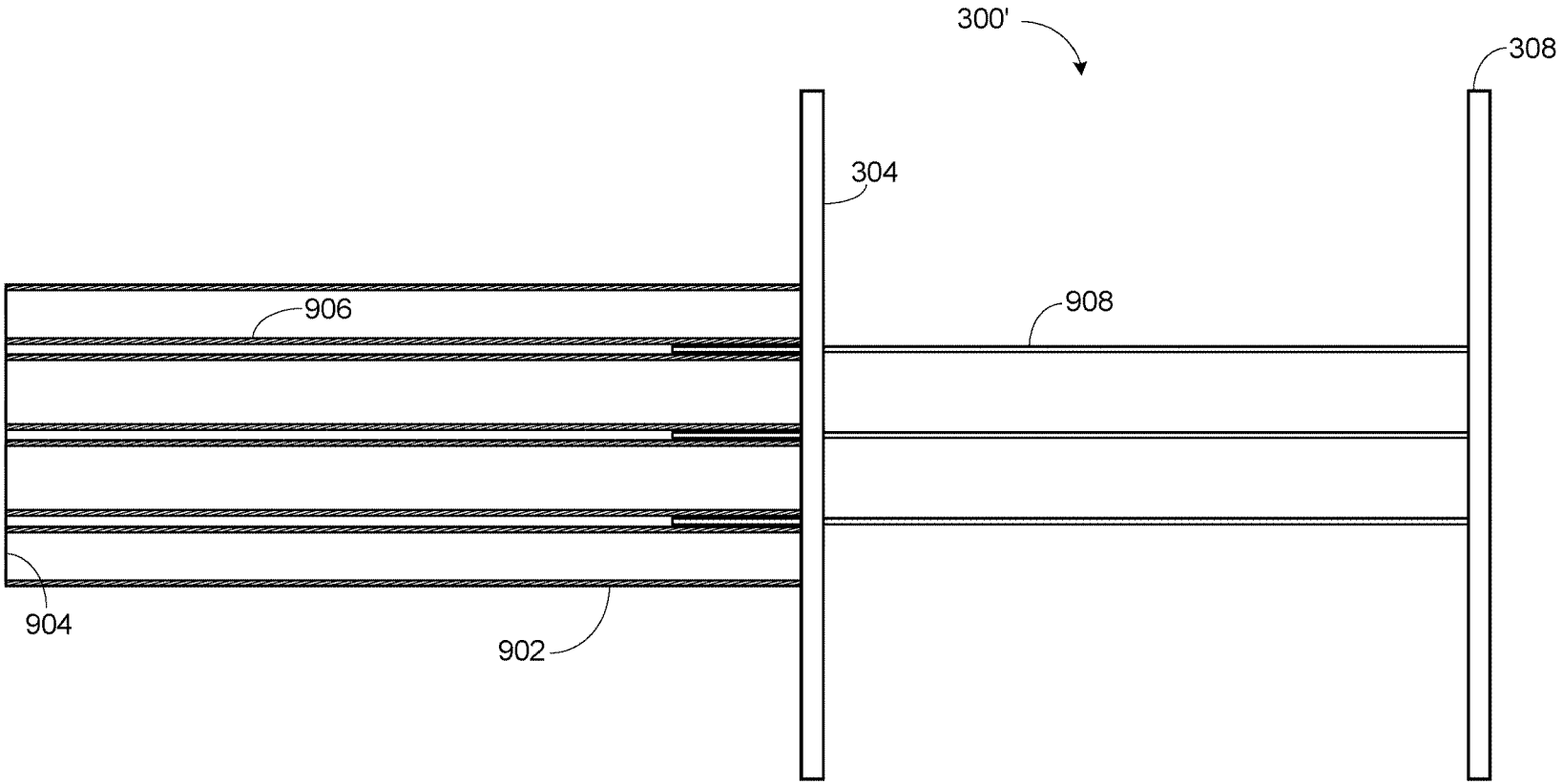
FIG. 9 is an alternate embodiment of a speed loader according to the present invention including a stabilizing cylinder.
Figure 11:
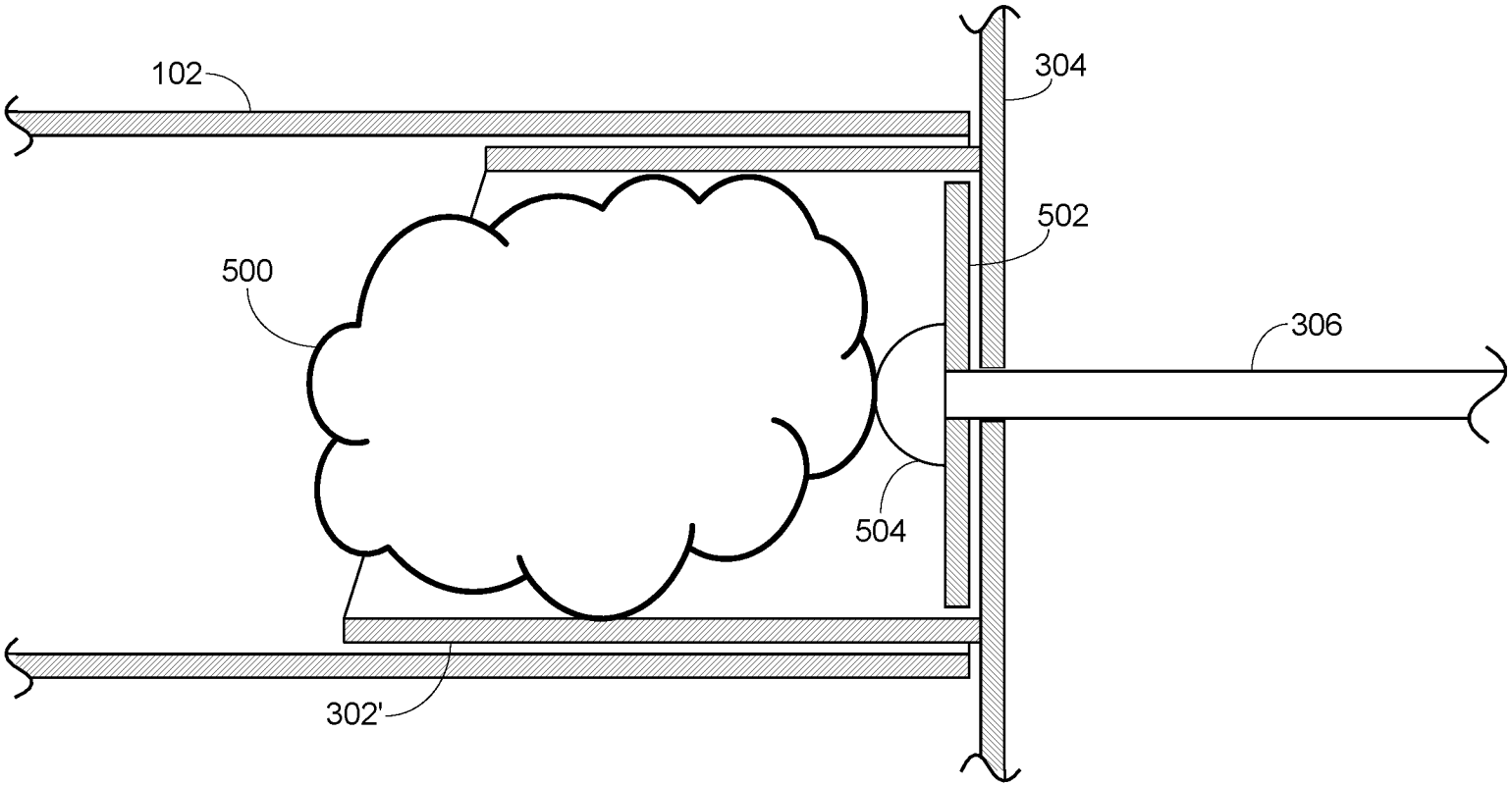
FIG. 11 is a partial cross-sectional view of FIG. 5 with an alternate configuration of the speed loader tubes.

Depending upon the particular materials chosen for the pushrods 306 and their actual length, there may be a tendency to have the plate 308 rack with regard to the plate 304, which may hinder pushing of the T-shirts 500 into the tubes 102. To address this concern, an anti-racking cylinder 902 can be provided as shown in FIG. 9. The cylinder 902 is attached to the plate 304, preferably inside the ring of the tubes 302. The cylinder 902 is rigidly mounted to the plate 304 and includes a closed end 904. A series of guide tubes 906 are located inside the cylinder 902 and extend from the plate 304 to the end 904. Preferably the guide tubes 906 are firmly mounted at both ends. A series of guide rods 908 are mounted to the plate 308 and inserted through the plate 304 into the guide tubes 906. Preferably the clearance between the guide rods 908 and the inner diameter of the guide tubes 906 is nominal to allow a positive retention with limited slop. By having the cylinder 902 firmly mounted to the plate 304, the guide tubes 906 provide a secure foundation for the guide rods 908, to limit any potential racking of the plate 308 with respect to the plate 304.

FIG. 10 is a perspective view of the T-shirt Gatling gun 100 in conjunction with a speed loader 300' which includes the cylinder 902. As can be seen, the cylinder 902 fits inside the circle of the tubes 102 and is preferably of a length that does not bottom out on the plate 104 when the speed loader 300' is in position for loading.

In some cases, it may be difficult to align the tubes 302 and 102, in the illustrated example 12 tubes, if all of the tubes are finished at their open ends perpendicular to the their axis. Figure n illustrates an alternate embodiment of tubes 302' where the protruding ends of the tubes 302' are not cut perpendicular to the axis of the tubes 302' but rather have an angle such that the end surfaces of the tubes 302' are angled with respect to the plane of the end of the tubes 102 to allow faster alignment in the tubes 102. While a single angle is shown, it is understood that various alternatives could be used to finish the ends of the tubes 302 to allow improved registration.

The use of the speed loader 300 with the T-shirt Gatling gun 100 is straightforward. The speed loader 300 has the pushrods 306 fully retracted and T-shirts 500 loaded into the tubes 302. After a full round of T-shirts has been fired from the T-shirt Gatling gun 100 and it is now empty, the speed loader 300 fully loaded with the T-shirts 500 has the tubes 302 registered with the tubes 102 of the T-shirt Gatling gun 100 and the push plate 308 is depressed, thus extending the pushrods 306 and the T-shirts 500 into the tubes 102. When the push plate 308 is fully pushed and T-shirts 500 are properly located, the speed loader 300 is simply withdrawn from the T-shirt Gatling gun 100 and placed aside. This allows significantly faster loading of the loading of the T-shirt Gatling gun 100 as compared to manually trying to insert T-shirts individually into each one of the tubes 102. If desired, a series of speed loaders 300 can be readied to allow extremely long firing times of the T-shirt Gatling gun 100.

While T-shirts have been used as the example object, it is understood that many other objects can be used, such as stress balls, miniature footballs and the like. While the examples have used a single ring of 12 tubes, it is understood that other numbers of tubes could be used and multiple rings of tubes could be used, with the speed loader matching the tube configuration of the Gatling gun.

In certain designs of T-shirt Gatling guns, the end of the Gatling gun is not completely open as in the illustrated embodiment but a mechanism is present across the end to hold a rotation point and extending tubes for firing the T-shirts. In such a case, a fully circular speed loader as disclosed in the preferred embodiments will not be usable. In such a case, a speed loader that is just an arc or pie-shaped segment of the full circular design can be used to load T-shirts into a portion of the exposed tubes. Even with the then required multiple loadings, operation is still much faster than entirely manual operations.

While no specific materials have been discussed, other than a preference of clear plastic for the tubes 102, it is understood that a variety of materials can be used for the various items. The various plates can be formed of wood, plastic or metal, though plastic is preferred for weight savings. The pushrods can be threaded metal rods or smooth rods with threaded ends. The various items can be affixed to the plates using various methods, such as glues or threading. The guide rods are preferably smooth rods but need not be metal. A handle could be applied to the push plate 308 to aid pushing, withdrawal and retraction. Other variations of the materials will be apparent to one skilled in the art.

The above description is intended to be illustrative, and not restrictive. For example, the above-described embodiments may be used in combination with each other. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein."

What is claimed is:

1. A speed loader for use with a T-shirt Gatling gun, the T-shirt Gatling gun having a plurality of first tubes circumferentially located about a central axis, the first tubes having an open end, an inner diameter and a first length, the first tubes sized to allow insertion of an object to be propelled, the object having a diameter less than the inner diameter of the first tubes and having a length, the speed loader comprising:

a plurality of second tubes circumferentially located around a central axis, the second tubes having an axis, a first open end, a second end, an outer diameter and a second length, the second tube outer diameter being less than the first tube inner diameter, the second length being at least the length of the object to be propelled, the circumferential location of the second tubes conforming to the circumferential location of the first tubes;

a plate having a thickness and a size greater than the arrangement of the second tubes, the second end of the second tubes affixed to the plate, the plate having an opening at the axis of each of the plurality of second tubes;

a plurality of pushrods, each pushrod coaxially located with a respective tube of the plurality of second tubes and passing through an opening in the plate, each pushrod having first and second ends and a length substantially equal to the length of the first tubes and the thickness of the plate less the length of the object, the first end for contacting the object when the object is located in a second tube; and a push plate similarly sized to the plate, the second ends of the plurality of pushrods affixed to the push plate.

2. The speed loader of claim 1, wherein each pushrod includes an end plate located at the first end of the pushrod to improve pushing of the object.

3. The speed loader of claim 2, wherein each pushrod further includes a nut retaining the end plate at the first end of the pushrod.

4. The speed loader of claim 1, wherein the plurality of first tubes and the plurality of second tubes form a complete circle.

5. The speed loader of claim 1, wherein the plurality of first tubes and the plurality of second tubes form an arc of a circle.

6. The speed loader of claim 1, further comprising:

an anti-racking cylinder having an outer diameter to fit within the plurality of first tubes and the plurality of second tubes and having a closed end and a second end, the second end affixed to the plate;

a plurality of guide tubes located inside the anti-racking cylinder, each guide tube affixed to the closed end of the anti-racking cylinder and to the plate, the plate further having openings at the locations of the guide tubes; and a plurality of guide rods, equal in number to the plurality of guide tubes, each guide rod having a first end and a second end, the second end affixed to the push plate, each guide rod passing through an opening in the plate into a guide tube.

* * * * *